US009398368B2

(12) United States Patent
Mok et al.

(10) Patent No.: US 9,398,368 B2
(45) Date of Patent: Jul. 19, 2016

(54) DISPLAY DEVICE

(71) Applicant: Samsung Display Co., Ltd., Yongin, Gyeonggi-Do (KR)

(72) Inventors: Rang-Kyun Mok, Yongin (KR); Yi-Joon Ahn, Yongin (KR); Jong-In Baek, Yongin (KR); Tae-Hee Lee, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/567,883

(22) Filed: Dec. 11, 2014

(65) Prior Publication Data

US 2015/0373451 A1 Dec. 24, 2015

(30) Foreign Application Priority Data

Jun. 23, 2014 (KR) ..... 10-2014-0076632

(51) Int. Cl.
*H04R 1/28* (2006.01)

(52) U.S. Cl.
CPC ..... *H04R 1/2803* (2013.01); *H04R 2499/11* (2013.01)

(58) Field of Classification Search
CPC ..... H04R 1/02; H04R 1/105; H04R 1/08; H04R 1/025; H04R 1/026
USPC ..... 381/333–334, 365, 388
See application file for complete search history.

(56) References Cited

U.S. PATENT DOCUMENTS

2007/0029131 A1 2/2007 Pan et al.

FOREIGN PATENT DOCUMENTS

| | | | |
|---|---|---|---|
| JP | 8-195996 | A | 7/1996 |
| JP | 2007-49702 | A | 2/2007 |
| KR | 10-2007-0104190 | A | 10/2007 |
| KR | 10-2009-0109424 | A | 10/2009 |
| KR | 10-2012-0129081 | A | 11/2012 |
| WO | WO 2007/123292 | A1 | 11/2007 |

*Primary Examiner* — Suhan Ni
(74) *Attorney, Agent, or Firm* — Knobbe, Martens, Olson & Bear, LLP

(57) ABSTRACT

A display device is disclosed. In one aspect, the device includes a display module, a first cover configured to support the display module and a second cover placed opposed to the first cover and selectively detachably coupled to the first cover. The device also includes a volume changer configured to connect the first and second covers and define an inner space, having a volume, with the first and second covers, wherein the volume changer has an adjustable length extending from the second cover to the first cover, and wherein the volume changer is configured to change the volume of the inner space when the length is adjusted. The device further includes at least one exciter mounted in the inner space and configured to generate sound.

21 Claims, 5 Drawing Sheets

DISPLAY DEVICE

CROSS-REFERENCE TO RELATED APPLICATIONS

This application claims the benefit of Korean Patent Application No. 10-2014-0076632, filed on Jun. 23, 2014 in the Korean Intellectual Property Office, the disclosure of which is incorporated herein in its entirety by reference.

BACKGROUND

1. Field

The described technology generally relates to a display device.

2. Description of the Related Technology

Mobile terminals have functionality including performing voice and image calls, inputting and outputting information, storing data, and the like.

The basic functionality is implemented as a comprehensive multimedia player while being augmented with complex functions including shooting a photo or a video, reproducing music or video files, playing games, receiving broadcasting, and performing wireless internet and the like.

In general, mobile terminals display image information via a display panel and output voice information in the form of sound via a speaker. Particularly, as more and more users listen to music and watch the news and the image information with sound, many research and development projects have been directed to effectively transmitting a sound frequency range that users prefer.

SUMMARY OF CERTAIN INVENTIVE ASPECTS

One inventive aspect is a display device.

Another aspect is a display device which includes a display module; a first cover that supports the display module; a second cover that is placed opposed to the first cover and coupled to or separated from the first cover selectively; a volume change unit that forms an inner space by connecting the first cover and the second cover and varies the volume of the inner space by changing its length; and one or more exciters that are mounted in the inner space and generates the sound.

The one or more exciters may be mounted on at least one of the first cover and the second cover.

The volume change unit may vary the distance between the first cover and the second cover.

The volume change unit may also connect the edges of the first cover and the second cover.

The volume change unit may be formed in a bellows shape.

The second cover may include one or more passing holes through which the sound generated by vibrations of the one or more exciters flow to the outside.

In some embodiments, the first cover has at least one projection around the edge and the second cover has at least one groove around the edge. Thus, the first cover may be coupled to the second cover by inserting the at least one projection into the at least one groove.

The display device may further include an acoustic lens unit that is connected to the second cover and changes the path of the sound generated by vibrations of the one or more exciters.

The display device may further include a support unit that maintains the volume of the inner space by supporting the first cover and the second cover.

The support unit may be formed in an elastic material.

Another aspect is a display device which includes a display module; a first cover that is mounted on the display module; a separating case that is coupled to or separated from the first cover selectively and, when separated, forms an inner space and varies the volume of the inner space by changing the length of the separating case; and the one or more exciters that are mounted in the inner space and generates the sound.

The separating case may include a second cover that is coupled to the first cover selectively; and a volume change unit that connects the first cover and the second cover and thus when the second cover is separated from the first cover, forms a inner space. The volume change varies the volume of the inner space by changing its length.

The separating case may be formed in a bellows shape.

The separating case may be connected to the edge of the first cover.

The separating case may include one or more passing holes through which the sound generated by vibrations of the one or more exciters flow to the outside.

The display device may further include a acoustic lens unit that is connected to the separating case and changes the path of the sound generated by vibrations of the one or more exciters. The display device may further include a support unit that maintains the volume of the inner space by supporting the first cover and the second cover.

Another aspect is a display device comprising: a display module; a first cover configured to support the display module; a second cover placed opposed to the first cover and selectively detachably coupled to the first cover; a volume changer configured to connect the first and second covers and define an inner space, having a volume, with the first and second covers, wherein the volume changer has an adjustable length extending from the second cover to the first cover, and wherein the volume changer is configured to change the volume of the inner space when the length is adjusted; at least one exciter mounted in the inner space and configured to generate sound.

In the above device, the exciter is mounted on at least one of the first and second covers. In the above device, the volume changer is further configured to vary the distance between the first and second covers. In the above device, the volume changer is further configured to connect edges of the first and second covers. In the above device, the volume changer has a bellows shape. In the above device, the second cover has at least one hole through which the sound passes. In the above device, the first cover has at least one projection around an edge thereof and wherein the second cover has at least one groove around an edge thereof into which the at least one projection is inserted.

The above device further comprises: an acoustic lens unit connected to the second cover and configured to change a path of the sound. The display device further comprises: a support configured to support the first and second covers so as to maintain the volume of the inner space. In the above device, the support is formed of an elastic material. In the above device, the at least one exciter is located between the support and the volume changer. In the above device, the volume changer is further configured to amplify the sound in frequency ranges between about 200 Hz and about 2000 Hz when the volume of the inner space expands.

Another aspect is display device comprising: a display module; a first cover mounted on the display module; a separating case selectively detachably coupled to the first cover and, configured to define an inner space, having a volume, with the first cover, wherein the separating case has an adjustable height extending toward the first cover, and wherein the separating case is further configured to change the volume of the inner space when the height is adjusted; and at least one exciter mounted in the inner space and configured to generate sound.

In the above device, the separating case comprises a second cover selectively coupled to the first cover; and a volume changer configured to connect the first cover and the second cover and configured to define the inner space with the first and second covers, and wherein the volume changer has an adjustable length extending from the second cover to the first cover, and wherein the volume changer is configured to change the volume of the inner space when the length is adjusted. In the above device, the volume changer has a bellows shape. In the above device, the separating case is connected to an edge of the first cover. In the above device, the separating case has at least one hole through which the sound passes.

The above device further comprises: an acoustic lens unit connected to the separating case and configured to change a path of the sound. The above device further comprises: a support configured to support the first and second covers so as to maintain the volume of the inner space. In the above device, the separating case is further configured to amplify the sound in frequency ranges between about 200 Hz and about 2000 Hz when the volume of the inner space expands.

DETAILED DESCRIPTION OF CERTAIN INVENTIVE EMBODIMENTS

Figure 1:
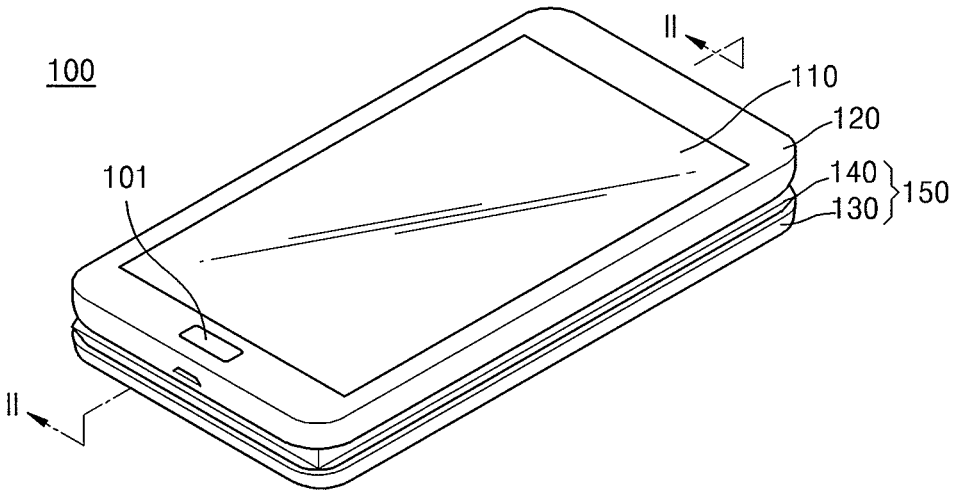
FIG. 1 is a schematic perspective view of a display device according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. Expressions such as "at least one of," when preceding a list of elements, modify the entire list of elements and do not modify the individual elements of the list. It will be understood that although the terms "first," "second," etc. may be used herein to describe various components, these components should not be limited by these terms. These components are only used to distinguish one component from another. As used herein, the singular forms "a," "an" and "the" are intended to include the plural forms as well, unless the context clearly indicates otherwise. It will be further understood that the terms "comprises" and/or "comprising" used herein specify the presence of stated features or components, but do not preclude the presence or addition of one or more other features or components. Sizes of elements in the drawings may be exaggerated for convenience of explanation. In other words, since sizes and thicknesses of components in the drawings are arbitrarily illustrated for convenience of explanation, the present invention is not limited thereto.

In this disclosure, the term "substantially" includes the meanings of completely, almost completely or to any significant degree under some applications and in accordance with those skilled in the art. Moreover, "formed on" can also mean "formed over." The term "connected" includes an electrical connection.

Figure 2:
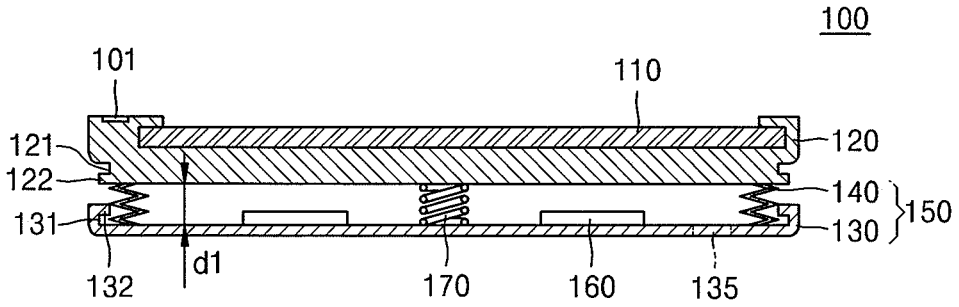
FIG. 2 is a cross-sectional view of the display device, taken along a line II-II of FIG. 1.

Referring to FIGS. 1 and 2, the display device 100 includes a display module 110, a first cover 120, a separating case 150, one or more exciters 160, and a support unit or support 170. The display module 110 may be manufactured by using liquid crystal displays, light-emitting diodes, organic light-emitting diodes, and the like and output image information. In some embodiments, the display module 110 is used as an input apparatus equipped with a touch panel. For example, when a resistive touch panel or a capacitive touch panel is mounted on one of the surfaces of the display device 100, the display module 110 can be used as a touch screen.

The first cover 120 is connected to the display module 110 and thus supports the display module 110. The first cover 120 may protect the inner components of the display device 100 including the display module 110. The first cover 120 may be made of synthetic resins. The first cover 120 may also be made of metal and alloy materials including stainless steel or Titanium (Ti).

The first cover 120 may have an input end 101 on one side thereof. The input end 101 may be a button-style input end that users press or a touch-style input end where users can input commands or information by touching a part of the first cover 120.

The first cover 120 includes at least one first projection 122 and at least one first groove 121 in at least some portions along the edge of the first cover 120 in order to be coupled to a second cover 130. If the at least one first projection 122 is inserted into at least one second groove 131 of the second cover 130 and at least one second projection 132 of the second cover 130 is inserted into the at least one first groove 121, the first cover 120 and the second cover 130 may be coupled to each other. For example, the at least one first projection 122 and the at least one first groove 121 can be formed in some portions of the edge of the first cover 120 or around the whole edge of the first cover 120. In the following embodiment, the at least one first projection 122 and the at least one first groove 121 are formed around the whole edge of the first cover 120.

Some portions of the separating case 150 may be detachably coupled to the first cover 120 selectively and may form an inner space after being separated from the first cover 120. In some embodiments, the height of the separating case 150 or the length of the volume change unit 140 is adjustable. The separating case 150 may vary the volume of the inner space by changing the distance (or the height) thereof from the first cover 120. The separating case 150 may include the second cover 130 and a volume change unit 140.

The second cover 130 may be placed opposed to the first cover 120. The second cover 130 may be detachably coupled to the first cover 120 due to changes in the volume of the inner space formed by the separating case 150. The material of the second cover 130 may be the same as the material of the first cover 120.

The second cover 130 includes the at least one second projection 132 and the at least one second groove 131 around an edge of the second cover 130 in order to be coupled to the first cover 120. The at least one second projection 132 and the at least one second groove 131 may be formed to correspond to the at least one first groove 121 and the at least one first projection 122 of the first cover 120. If the at least one second projection 132 is inserted into the at least one first groove 121 of the first cover 120 and the at least one first projection 122 of the first cover 120 is inserted into the at least one second groove 131, the first cover 120 and the second cover 130 may be coupled to each other.

The second cover 130 may include a passing hole 135 that passes through the second cover 130 and connects the inner space formed by the separating case 150 and the outer space of the display device 100. Sound generated by the one or more exciters 160 may be output through the passing hole 135.

The number of passing holes 135 and arrangement thereof are not limited to a specific number and a specific arrangement and may be changed depending on the need of users. For example, the second cover 130 may have the passing holes throughout the second cover 130 and output sound waves from the whole surface of the second cover 130. Also, the passing hole 135 may be formed adjacent to the one or more exciters 160 and thus sound waves generated by the one or more exciters 160 may pass through the passing hole 135 rapidly.

The volume change unit or volume changer 140 may be connected to the edges of the first cover 120 and the second cover 130. The volume change unit 140 may vary the volume of the inner space formed by the separating case 150 by changing the distance between the first cover 120 and the second cover 130.

The volume change unit 140 may be formed in a bellows shape and thus minimize the distance between the first and second covers 120 and 130. For example, the volume change unit 150 may be formed with folds and may not be seen from the outside when the first cover 120 is coupled to the second cover 130.

The volume change unit 140 may be formed with materials that expand and contract and thus vary the distance between the two covers 120 and 130 by applying force. For example, the volume change unit 140 may be formed with a rubber material. In this case, when the volume change unit 140 expands, the distance between the first and second covers 120 and 130 increases and thus the volume of the inner space may increase. Also, when the volume change unit 140 contracts, the first cover 120 contacts the second cover 130 and the volume change unit 140 may be positioned between the covers 120 and 130.

The exciters 160 may be mounted in the inner space formed by the separating case 150 and generate sound. The exciters 160 may be mounted to contact at least one of the first cover 120 and the second cover 130.

The exciters 160 may amplify sound by vibrating the air therearound. For example, the exciters 160 may amplify sound which passes through a medium by vibrating the medium. The exciters 160 can vibrate the first cover 120 or the second cover 130 directly so that sound may be amplified due to the vibration of the air around the first cover 120 or the second cover 130.

Figure 3:
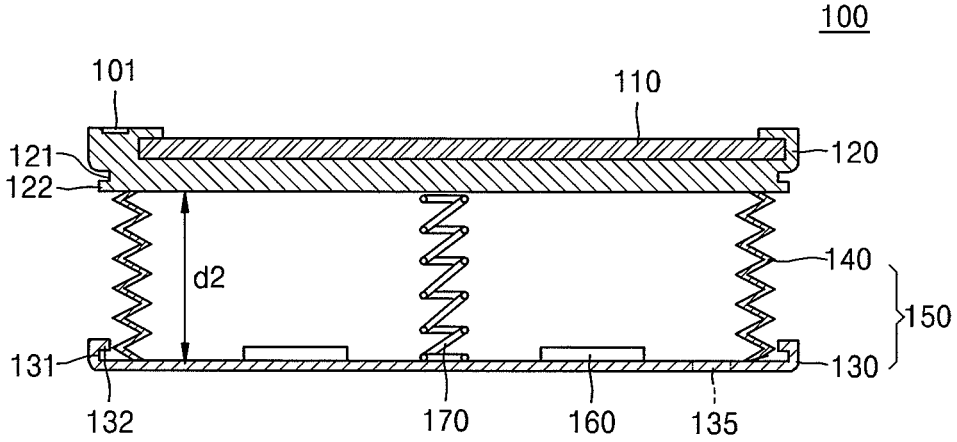
FIG. 3 is a cross-sectional view of the display device in which a volume change unit of FIG. 2 expands.

In FIG. 3, the exciters 160 are mounted to contact the second cover 130. However, the exciters 160 may be mounted to contact the first cover 120 to amplify sound by vibrating the first cover 120 and the display module 110.

The support unit 170 may be positioned between the first cover 120 and the second cover 130. The support unit 170 may maintain the increased volume of the inner space by supporting the first and second covers 120 and 130. The support unit 170 may help the volume change unit 140 to expand and contract when formed with elastic materials or in elastic shapes. For example, the support unit 170 may be formed in a pillar shape using an elastic material like silicone, rubber, and the like, or in a spring shape using a wire.

The number of support units 170 and arrangement thereof are not limited to a specific number and arrangement. For example, the support unit 170 may be positioned in the middle of the display device 100 as a single unit or multiple support units 170 may be positioned adjacent to the volume change unit 140. In the following embodiment, the support unit 170 is mounted in the middle of the display device 100 and supports the first cover 120 and the second cover 130.

FIG. 3 is a cross-sectional view that shows the display device 100 in which the volume change unit 140 of FIG. 2 is changed.

Referring to FIGS. 2 and 3, the change in the volume of the display device 100 will be explained.

In FIG. 2, the first cover 120 does not contact the second cover 130, but FIG. 2 is illustrated only for explaining the volume change unit 140. The first cover 120 and the second cover 130 may be fixed by contacting each other.

If the first projection 122 of the first cover 120 is inserted into the second groove 131 of the second cover 130, and the second projection 132 of the second cover 130 is inserted into the first groove 121 of the first cover 120, the first cover 120 and the second cover 130 are fixed. Here, the distance d1 between the first and second covers 120 and 130 is formed. When users do not need to amplify sound or change a sound frequency range, the volume of the display device 100 may be minimized by combining the first cover 120 and the second cover 130.

In some embodiments, the length of the volume change unit 140 is adjustable. When the length of the volume change unit 140 increases, the distance between the two covers 120 and 130 increases from d1 to d2. The support unit 179 may maintain the increased volume of the inner space by the volume change unit 140 by supporting the first cover 120 and the second cover 130.

In this case, when the exciters 160 operate, the inside air is vibrated by the exciters 160 and thus the sound frequency range may be changed. The first cover 120 or the second cover 130 that contacts the exciters 160 are vibrated to vibrate the air around the first cover 120 or the second cover 130 and thus the sound frequency range may be changed.

The support unit 170 of the display device 100 may expand, as shown in FIG. 3, from the contracted state of the support unit 170, as shown in FIG. 2. The support unit 170 may increase the volume of the inner space of the display device 100 easily using elasticity. Since the maximum volume of the inner space is determined by the length of the support unit 170, users may set a certain sound frequency range by setting the length of the support unit 170. Also, even when the inner space of the display device 100 expands and contracts repeatedly, the sound amplified is constant because the volume of the inner space of the display device 100 is maintained constant by the support unit 170 and thus predictability may be improved.

Figure 4:
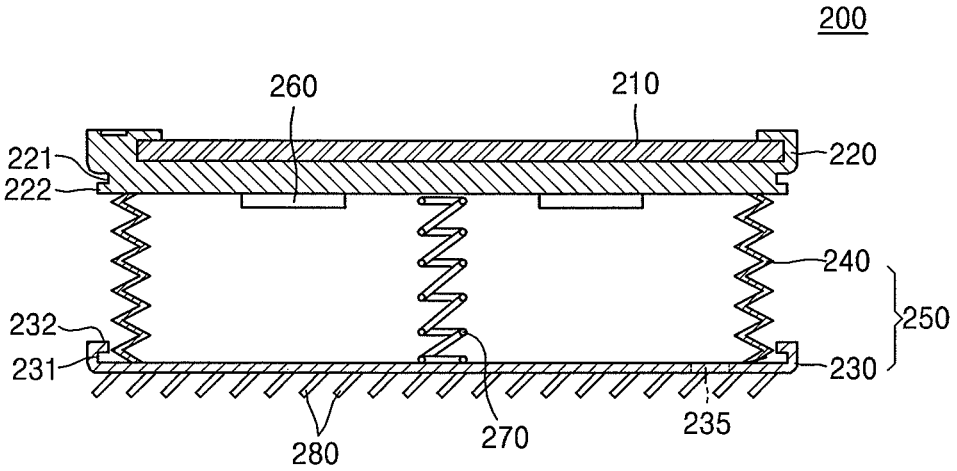
FIG. 4 is a cross-sectional view of a display device according to another embodiment.

FIG. 4 is a cross-sectional view of a display device 200 according to another embodiment.

Referring to FIG. 4, the display device 200 includes a display module 210, a first cover 220, a separating case 250, one or more exciters 260, a support unit or support 270, and an acoustic lens unit 280. The separating case 250 includes a second cover 230 and a volume change unit 240. Since the display module 210, the first cover 220, the separating case 250, the exciters 260, and the support unit 270 are the same as those in the display device 100 of the above embodiment except that the exciters are placed on the first cover 220, detailed explanations thereof are omitted hereinafter. The first cover 220 includes at least one first projection 222 and at least one first groove 221 in at least some portions along edges thereof. The second cover 230 includes at least one second projection 232 and at least one second groove 231 around edges thereof.

The acoustic lens unit 280 is mounted to connect to the second cover 230 and may change the path of sound waves. The acoustic lens unit 280 may focus sound waves generated by the vibrations of the exciters 260. The acoustic lens unit 280 is connected to the second cover 230 and may change the path of sound which flows through a passing hole 235. When the sound frequency range is changed due to the vibration of the second cover 130, the acoustic lens unit 280 may change the path of sound.

The acoustic lens unit 280 may be mounted on the second cover 230 pivotably. When the volume change unit 240 contracts and thus the sound frequency range does not need to be changed, the acoustic lens unit 280 may contact the surface of the second cover 230 or be inserted into a slit (not shown) formed within the second cover 230. When the sound frequency range is changed after the volume change unit 240 expands and sound waves need to be focused, the acoustic lens unit 280 pivots and protrudes. When the acoustic lens unit 280 protrudes from the surface of the second cover 230, the air of the inner space of the volume change unit 240 may flow through the acoustic lens unit 280 to the outside.

Figure 5:
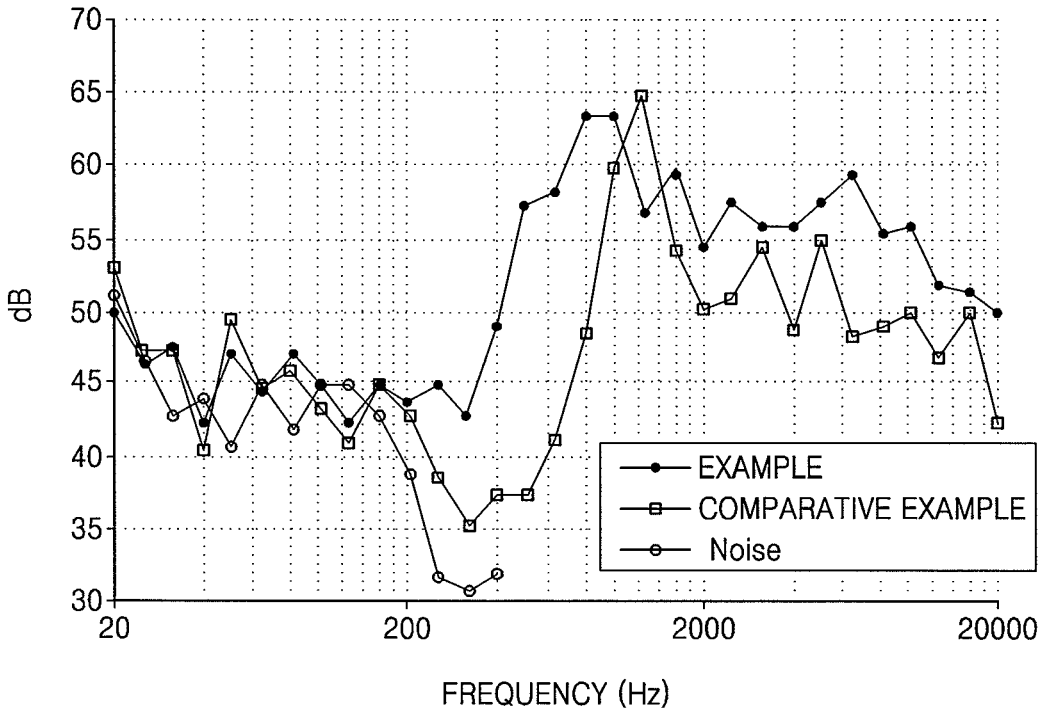
FIG. 5 is a graph that shows a relationship between sound pressure and a sound frequency range used in a display device, according to one or more embodiments.

FIG. 5 is a graph that shows the relationship between sound pressure and an sound frequency range used in a display device, according to an embodiment.

The x-axis denotes sound frequency (Hz) and the y-axis denotes sound pressure (dB). According to an experiment, sound pressure was measured while changing the sound frequency range from about 20 Hz to about 20,000 Hz.

In a comparative example (marked as □ in FIG. 5), sound pressure was measured while changing the sound frequency range when the distance between the first cover 120 and the second cover 130 was d1 (see FIG. 2). In an example (marked as ● in FIG. 5), sound pressure was measured while changing the sound frequency range when the distance between the first cover 120 and the second cover 130 was d2. Noise (marked as ○ in FIG. 5) denotes noise that was generated in a laboratory conducting the experiment.

According to the experiment, the example (●), the comparative example (□), and the noise (●) have similar sound pressures (dB) in the sound frequency range in which the noise (●) was generated.

According to the experiment, the example (●) has a higher sound pressure than the comparative embodiment (□) in most of the sound frequency ranges over about 200 Hz. Thus, the display device 100 may improve sound pressure and intensity by expanding the inner space via the volume change unit 140.

Particularly, when referring to the result of an experiment in the low sound frequency ranges between about 200 Hz and about 2000 Hz, the sound pressure of the example (●) increases by 20 dB or so as compared to that of the comparative example (□). That is, the volume change unit 140 may further improve sound pressure and intensity in the relatively lower sound frequency ranges.

The display device 100 may include all kinds of information communication devices, multimedia players, and other applicable devices including all mobile communication terminals that operate based on communication protocols corresponding to various communication systems, portable multimedia players (PMP), digital broadcasting players, personal digital assistants (PDAs), music players (e.g. MP3 players), portable game terminals, smart phones, notebooks, and handheld PCs.

The display device 100 may improve sound pressure by changing the volume of the inner space in the display device 100 depending on users' choices. Particularly, the display device 100 may improve sound pressure in the low sound frequency ranges.

The display device 100 vibrates the air around the first cover 120 or the second cover 130 by using the first cover 120 or the second cover 130 as a diaphragm and thus may improve sound pressure.

When the display device 100 does not use a speaker, the volume change unit 140 is positioned between the first cover 120 and the second cover 130 and is not seen from the outside. Unless another apparatus is added in order to increase sound pressure, space efficiency may be improved.

The display device 200 may amplify sound easily since the display device 200 has the acoustic lens unit 280 for focusing sound.

As described above, according to at least one of the disclosed embodiments, sound pressure is improved due to the changes in the volume of the inner space fondled by the display device It should be understood that the exemplary embodiments described therein should be considered in a descriptive sense only and not for purposes of limitation. Descriptions of features or aspects within each embodiment should typically be considered as available for other similar features or aspects in other embodiments.

While the inventive technology has been described with reference to the figures, it will be understood by those of ordinary skill in the art that various changes in form and details may be made therein without departing from the spirit and scope of the present invention as defined by the following claims.

What is claimed is:

1. A display device comprising:

a display module having a top surface configured to display an image and a bottom surface opposing the top surface;

a first cover configured to support the display module, wherein the first cover has top and bottom surfaces opposing each other, and wherein the top surface of the first cover contacts the bottom surface of the display module;

a second cover placed opposed to the first cover and selectively detachably coupled to the first cover, wherein the second cover has top and bottom surfaces opposing each other, and wherein the top surface of the second cover faces the bottom surface of the first cover;

a volume changer connected to the bottom surface of the first cover and the top surface of the second cover, wherein an inner space is defined and surrounded by the volume changer, the bottom surface of the first cover and the top surface of the second cover, wherein the volume changer has an adjustable length extending from the second cover to the first cover, and wherein the volume changer is configured to change the volume of the inner space when the length is adjusted; and at least one exciter mounted in the inner space and configured to generate sound.

2. The display device of claim 1, wherein the exciter is mounted on at least one of the first and second covers.

3. The display device of claim 1, wherein the volume changer is further configured to vary the distance between the first and second covers.

4. The display device of claim 1, wherein the volume changer is further configured to connect edges of the first and second covers.

5. The display device of claim 1, wherein the volume changer has a bellows shape.

6. The display device of claim 1, wherein the second cover has at least one hole through which the sound passes.

7. The display device of claim 1, wherein the first cover has at least one projection around an edge thereof and wherein the second cover has at least one groove around an edge thereof into which the at least one projection is inserted.

8. The display device of claim 1, further comprising:

an acoustic lens unit connected to the second cover and configured to change a path of the sound.

9. The display device of claim 1, further comprising:

a support interposed between and configured to support the first and second covers so as to maintain the volume of the inner space, wherein the support is separate from and surrounded by the volume changer.

10. The display device of claim 9, wherein the support is formed of an elastic material.

11. The display device of claim 10, wherein the at least one exciter is located between the support and the volume changer.

12. The display device of claim 1, wherein the volume changer is further configured to amplify the sound in frequency ranges between about 200 Hz and about 2000 Hz when the volume of the inner space expands.

13. The display device of claim 1, further comprising a support interposed between and configured to support the first and second covers so as to maintain the volume of the inner space, wherein the support and the volume changer are configured to move together and have the same height.

14. A display device comprising:

a display module having a top surface configured to display an image and a bottom surface opposing the top surface;

a first cover mounted on the display module, wherein the first cover has top and bottom surfaces opposing each other, and wherein the top surface of the first cover contacts the bottom surface of the display module;

a separating case selectively detachably coupled to the first cover, wherein the separating case has top and bottom surfaces opposing each other, and wherein the top surface of the separating case faces the bottom surface of the first cover, wherein an inner space is defined and surrounded by the bottom surface of the first cover and the top surface of the separating case, wherein the separating case has an adjustable height extending toward the first cover, and wherein the separating case is further configured to change the volume of the inner space when the height is adjusted; and at least one exciter mounted in the inner space and configured to generate sound.

15. The display device of claim 14, wherein the separating case comprises a second cover selectively coupled to the first cover; and a volume changer connected to the bottom surface of the first cover and a top surface of the second cover, wherein the top surface of the separating case is the top surface of the second cover, and wherein the volume changer has an adjustable length extending from the second cover to the first cover, and wherein the volume changer is configured to change the volume of the inner space when the length is adjusted.

16. The display device of claim 15, wherein the volume changer has a bellows shape.

17. The display device of claim 14, wherein the separating case is connected to an edge of the first cover.

18. The display device of claim 14, wherein the separating case has at least one hole through which the sound passes.

19. The display device of claim 14, further comprising:

an acoustic lens unit connected to the separating case and configured to change a path of the sound.

20. The display device of claim 14, further comprising:

a support configured to support the first and second covers so as to maintain the volume of the inner space.

21. The display device of claim 14, wherein the separating case is further configured to amplify the sound in frequency ranges between about 200 Hz and about 2000 Hz when the volume of the inner space expands.

* * * * *